US007150582B2

(12) United States Patent
Burwell

(10) Patent No.: US 7,150,582 B2
(45) Date of Patent: Dec. 19, 2006

(54) FORM FOR STREET BOX IN UNDERGROUND STORAGE TANK INSTALLATION

(75) Inventor: John Burwell, Eagan, MN (US)

(73) Assignee: Xerxes Corporation, Minneapolis, MN (US)

( * ) Notice: Subject to any disclaimer, the term of this patent is extended or adjusted under 35 U.S.C. 154(b) by 0 days.

(21) Appl. No.: 11/080,403

(22) Filed: Mar. 16, 2005

(65) Prior Publication Data

US 2006/0210359 A1 Sep. 21, 2006

(51) Int. Cl.
*E02D 29/12* (2006.01)

(52) U.S. Cl. ..... 405/52; 405/53; 52/20

(58) Field of Classification Search ..... 405/52, 405/53, 55; 52/19, 20
See application file for complete search history.

(56) References Cited

U.S. PATENT DOCUMENTS 4,615,362 A * 10/1986 Hartman et al. ..... 52/20
4,717,036 A * 1/1988 Dundas et al. ..... 220/86.1
4,948,007 A 8/1990 Berg et al.
4,958,957 A * 9/1990 Berg et al. ..... 405/52
5,297,896 A * 3/1994 Webb ..... 405/52
5,372,454 A * 12/1994 Lawrence ..... 405/53
5,407,300 A * 4/1995 Guindon et al. ..... 405/53
5,501,243 A * 3/1996 Palazzo ..... 137/15.08
5,577,895 A * 11/1996 Franklin et al. ..... 417/238
5,595,456 A 1/1997 Berg et al.
5,720,404 A 2/1998 Berg et al.
5,950,860 A * 9/1999 Kesterman et al. ..... 220/324
6,167,608 B1 1/2001 Burwell et al.
6,171,029 B1 * 1/2001 McGill et al. ..... 405/55
6,266,928 B1 * 7/2001 Argandona ..... 405/52
6,398,057 B1 6/2002 Berg et al.
6,467,344 B1 10/2002 Ly et al.
6,517,719 B1 2/2003 Burwell et al.
6,551,024 B1 4/2003 Berg, Sr. et al.
6,564,614 B1 * 5/2003 Doris et al. ..... 73/49.2
6,698,610 B1 3/2004 Berg et al.
6,889,865 B1 5/2005 Burwell et al.
2003/0205499 A1 11/2003 Burwell et al.
2005/0155192 A1 7/2005 Burwell et al.
2005/0201830 A1 9/2005 Burwell et al.

* cited by examiner

*Primary Examiner*—Frederick L. Lagman
(74) *Attorney, Agent, or Firm*—Merchant & Gould PC

(57) ABSTRACT

A form suitable for use in an underground storage tank installation includes an upper portion sized and shaped to receive a street box and a lower portion that fits over and surrounds an upper portion of a riser on the tank. In preferred embodiments, the riser acts as a containment sump, a portion of the riser sidewall is double walled, and the bottom of the lower portion of the form extends to a depth below the top of the double walled portion of the riser. Preferably, the cross sectional shape of the form is circular and the bottom of the riser's lower portion is outwardly flanged, which serves to support the form during installation operations. The form has a stepped structure, with the upper portion of the form having a smaller circumference than the lower portion and a transition between the upper and lower portions forming the step.

18 Claims, 6 Drawing Sheets

FORM FOR STREET BOX IN UNDERGROUND STORAGE TANK INSTALLATION

BACKGROUND OF THE INVENTION

1. Field of the Invention

The invention relates generally to underground storage tanks and more particularly to the installation of street boxes for underground storage tanks including risers, especially double walled risers.

2. Discussion of the Background

Underground storage tanks are used in a wide variety of locations to store liquid materials underground. The stored materials are often harmful to the environment. Examples of such materials include gasoline and other petroleum products, e.g., oil and waste oil, as well as toxic raw materials and waste from manufacturing processes. Because of the harmful nature of these materials, it is especially important to ensure that underground storage tanks containing such materials do not leak or release these materials into the environment.

Concern over this possibility has lead many governmental authorities to require secondary containment for tanks that store such materials. One of the most common methods for providing secondary containment is through the use of multiple-walled underground storage tanks. The assignee of the present application, Xerxes Corporation, has manufactured and sold double walled underground storage tanks prepared from corrosion resistant materials such as fiber reinforced plastic (FRP) since 1984. These tanks have proven very reliable.

Underground storage tanks with manways often include risers. A riser is typically tubular, surrounds the manway, and extends from the manway upward to a point just beneath ground level. Risers often come equipped with covers. An example of a watertight riser cover is described in U.S. Pat. No. 5,595,496, owned by the assignee of the present application. Flex connectors or other devices in fluid communication with the interior of the tank sometimes pass through the wall of the riser and the manway covers. In such instances, it is known in the art for the riser to act as a containment sump to contain any leaks that occur at the joints between such devices and the manway cover and/or the joints between such devices and the riser wall.

A device known as a "street box" is often placed over the top of the riser and riser cover (if a riser cover is provided) to provide for access to the riser from ground level. A street box typically includes a 1" steel cover and a "box" that has a recessed lip for receiving the lid. The box can be any shape, but is often circular with a diameter larger than that of the riser.

In many installations, especially gasoline filling stations, the street box is subject to being driven over by cars and trucks. It is important to prevent the weight of these vehicles from being transferred to the riser. Therefore, street boxes in such situations are often set in concrete to distribute the force exerted on the street box by cars and trucks over a wide area.

Recently, concern for leaks has led the state of California to mandate secondary containment for such riser containment sumps. The assignee of the present application, Xerxes Corporation, has invented a double walled riser to meet this requirement for secondary containment as described in co-pending U.S. patent application Ser. No. 10/796,198, filed Mar. 10, 2004 and entitled "Double-Wall Containment Sumps", the entire contents of which are hereby incorporated by reference herein.

More recent California regulations include a requirement that there be a barrier between the riser sump and the backfill surrounding the riser from the point in the riser at which the double-wall containment ends (in the preferred embodiment of the aforementioned double wall riser application, this is a point near the top of the vertical wall of the riser) and ground level. The aforementioned concrete pad can serve this purpose if the depth of the concrete extends below the point in the riser sidewall at which the double containment ends. However, with known installation methods, meeting this requirement and verifying that this requirement has been complied with can be troublesome. What is needed are methods and devices that facilitate compliance and verification of compliance with the new California requirement.

SUMMARY

The aforementioned issues are addressed to a great extent by providing a form with an upper portion sized and shaped to receive a street box and a lower portion that fits over and surrounds an upper portion of the riser such that the bottom of the lower portion extends to a depth below an uppermost portion of the riser wall that provides double walled secondary containment protection. In preferred embodiments, the cross sectional shape of the form is circular. In some embodiments, the bottom of the lower portion is outwardly flanged, which serves to support the form during installation operations. The form is preferably stepped, with the upper portion having a smaller circumference than the lower portion and a transition between the upper and lower portions forming the step.

BRIEF DESCRIPTION OF THE DRAWINGS

The aforementioned advantages and features and embodiments will be more readily understood with reference to the following detailed description and the accompanying drawings in which.

DETAILED DESCRIPTION

In the following detailed description, a plurality of specific details, such as riser dimensions and materials, are set forth in order to provide a thorough understanding of the preferred embodiments discussed below. The details discussed in connection with the preferred embodiments should not be understood to limit the present invention. Furthermore, for ease of understanding, certain method steps are delineated as separate steps; however, these steps should not be construed as necessarily distinct nor order dependent in their performance.

Figure 1:
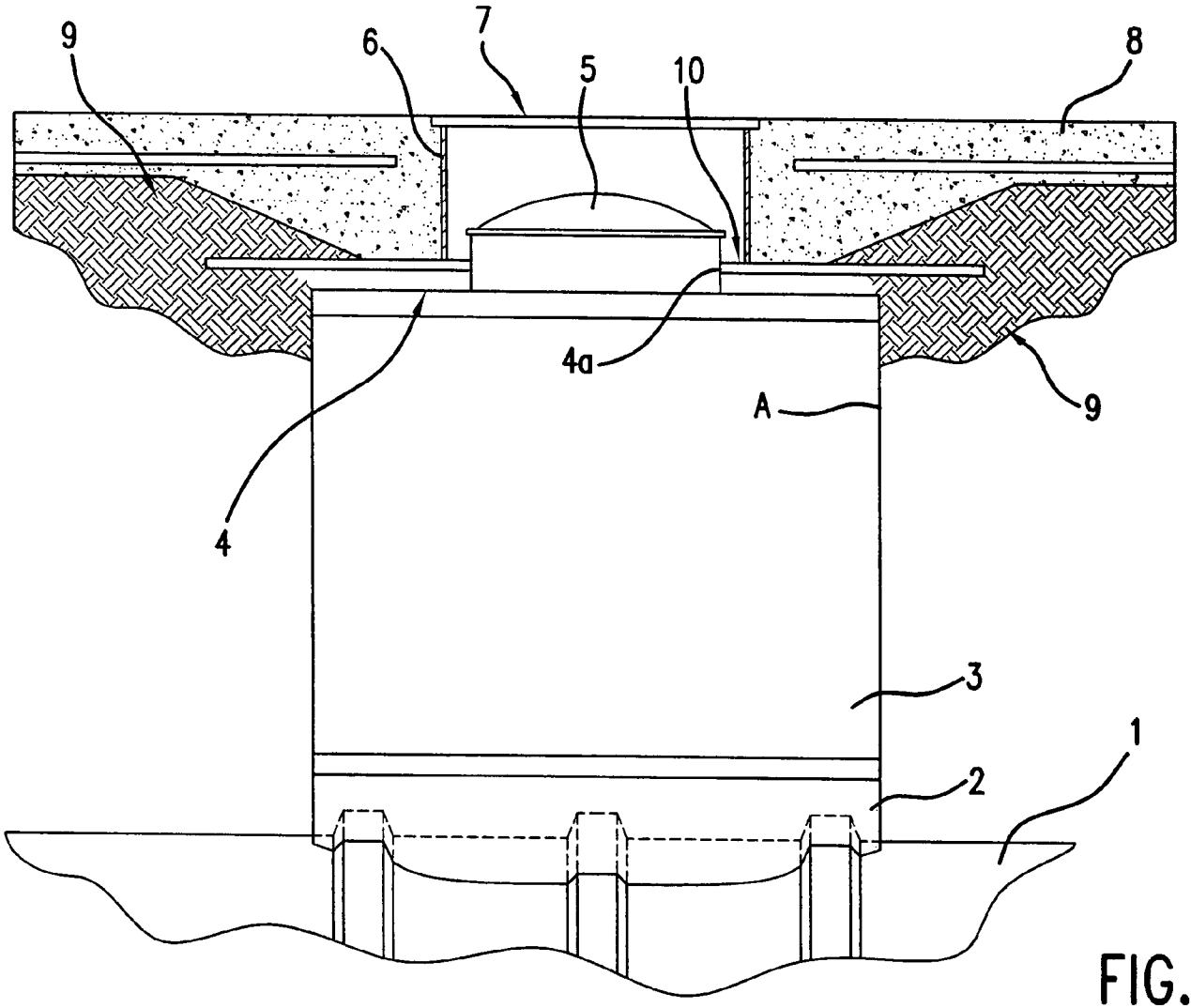
FIG. 1 PRIOR ART
FIG. 1 is a side view of a portion of a conventional underground gasoline storage tank installation including a street box and surrounding concrete pad.

FIG. 1 illustrates a typical underground gasoline storage tank installation of the type that might be found in a gasoline station. A double walled underground storage tank ("UST") includes a riser 3 attached to a riser collar 2. As will be appreciated by those of ordinary skill in the art, one or more pipe fittings typically extend through the wall of the riser 3 but are not illustrated in FIG. 1 for the sake of simplicity. The riser 3 includes a top 4 with a cover 5 which may or may not be watertight.

The riser cover 5 is surrounded by a street box 6, which typically includes a removable lid 7. The street box 6 is set in a concrete pad 8, which is poured over backfill 9. The assignee of the present invention, Xerxes Corporation, has in the past recommended using a barrier 10 such as a plywood sheet to ensure that there is a gap, of a recommended minimum of 3 inches, between the bottom of the concrete pad 8 (and any backfill 9) and the top of the riser 3. This is meant to ensure that any load exerted on the concrete pad 8 and the street box 6, which may be caused by cars or trucks driving over the same, is not transferred to the riser 3. Although the barrier 10 is shown as being adjacent to the vertical sidewall 4*a* beneath the riser cover 5, it should be understood that this is not a watertight connection and that there is typically a gap between the barrier 10 and the vertical sidewall 4*a* beneath the riser cover 5. In FIG. 1, the bottom of the cement pad extends only to the barrier 10, which is above the point A at which the double wall secondary containment of the riser ends.

Figure 2:
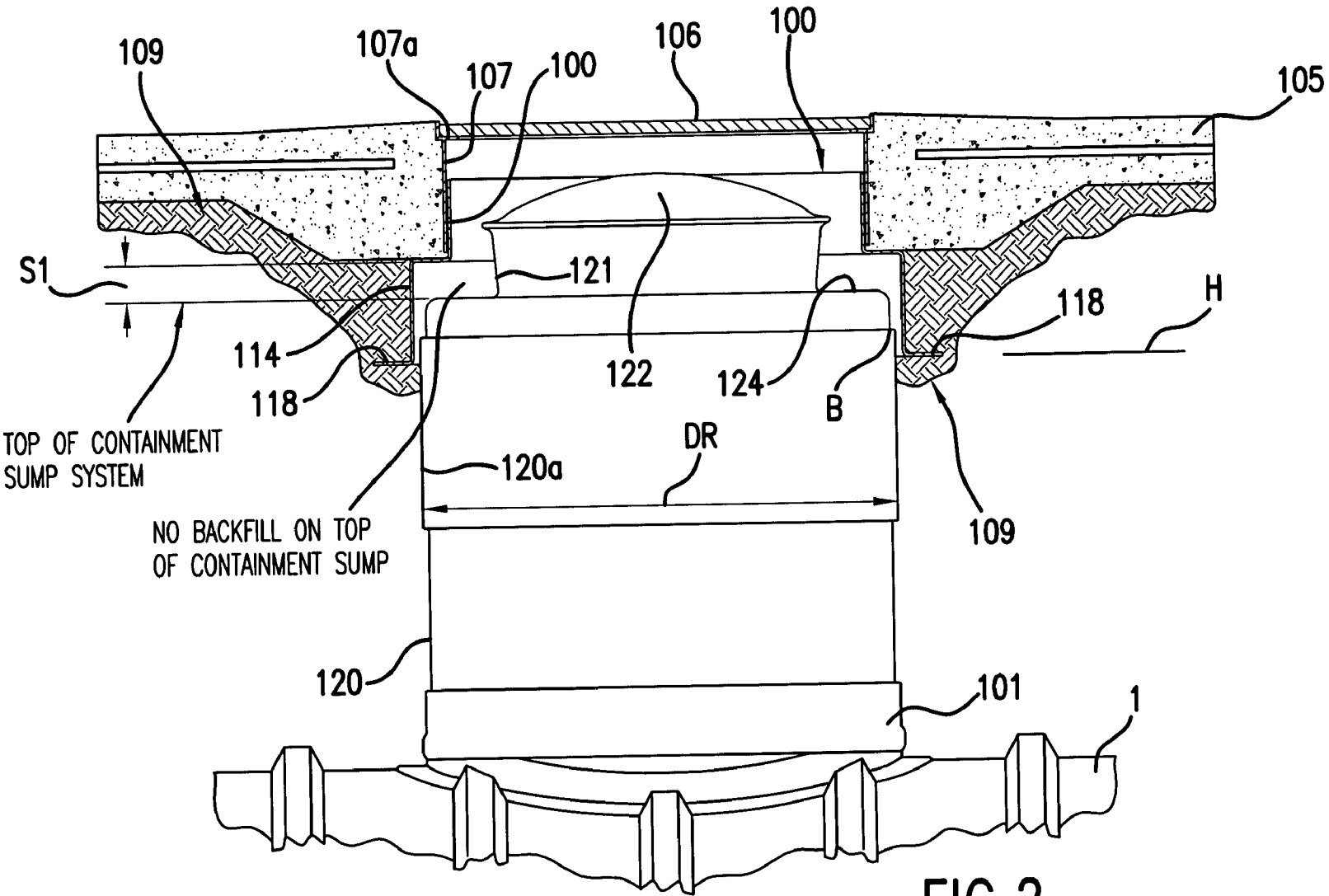
FIG. 2 is a side view of a portion of an embodiment of an underground gasoline storage tank installation including a riser surrounded by an embodiment of a form with an upper portion that accepts a street box and a lower portion that extends to a depth at which the riser provides double walled, secondary containment.

FIG. 2 illustrates an underground storage tank installation using a preferred embodiment of a form 100. A tank 1 is preferably formed from fiberglass and includes a riser collar 101 to which is attached a riser 120. The riser 120, which is also preferably fiberglass, is preferably a double-walled riser capable of acting as a containment sump such as that disclosed in the aforementioned co-pending patent application. The double walled portion of the riser sidewall 120*a* ends at a height indicated by point B. The top 124 of the riser 120 includes an opening 121, which is covered by a waterproof cover 122.

A form 100, also preferably formed from fiberglass, surrounds the upper portion of the riser 120. The form 100 is shown in greater detail in FIG. 3. The form 100 has an upper portion 112 with an outside diameter D1 that is greater than the diameter of the riser opening 121 and cover 122 of FIG. 1. The form 100 has a lower portion 114 with an inside diameter D2 that is greater than an outside diameter DR of the riser 120 (shown in FIG. 2). A horizontal surface 116 perpendicular to the sidewalls of the upper and lower portions 114, 114 forms the transition between the upper portion 112 and the lower portion 114, resulting in a stepped structure of the form 100. An outward flange 118 is connected to the bottom of the lower portion 114.

The flange 118 serves to support the form 100 during installation. Referring now back to FIG. 1, backfill 109 is positioned around the tank 100 until it reaches a height H, which is below the point B to which the double wall, secondary containment portion of the riser 120 extends. The form 100 is then positioned over the riser 120 such that the flange 118 rests on the backfill at height H. The street box 107 is then fitted to the upper portion 112 of the form 100. Then, additional backfill 109 and the cement pad 105 are installed. In some embodiments, the cement pad 105 may extend all the way downward to the flange 118. However, even if the cement pad 105 does not extend all the way to the flange 118 as shown in FIG. 2, the lower portion 114 serves as a leak barrier in the manner as the concrete pad would if it did extend all the way past the point B to the bottom of the flange. An additional aspect of the form 100 is that it provides for visual verification that the bottom of the form 100 extends below the point B on the riser at which the double walled, secondary containment is provided.

It should be understood by those of skill in the art that many variations in the form 100 are possible. For example, the transition between the upper and lower portions need not be horizontal as shown in the form 100 but rather may be at some non-perpendicular angle with respect to the sidewalls of the upper and lower portions. Additionally, the cross sectional shape of the form 100 need not be circular and may be square, hexagonal, octagonal, or of a cross sectional shape to match the multiple-sided risers illustrated in the above-reference co-pending double walled riser U.S. patent application. Further still, it should be understood that the flange 118 is omitted in some embodiments.

Figure 3:
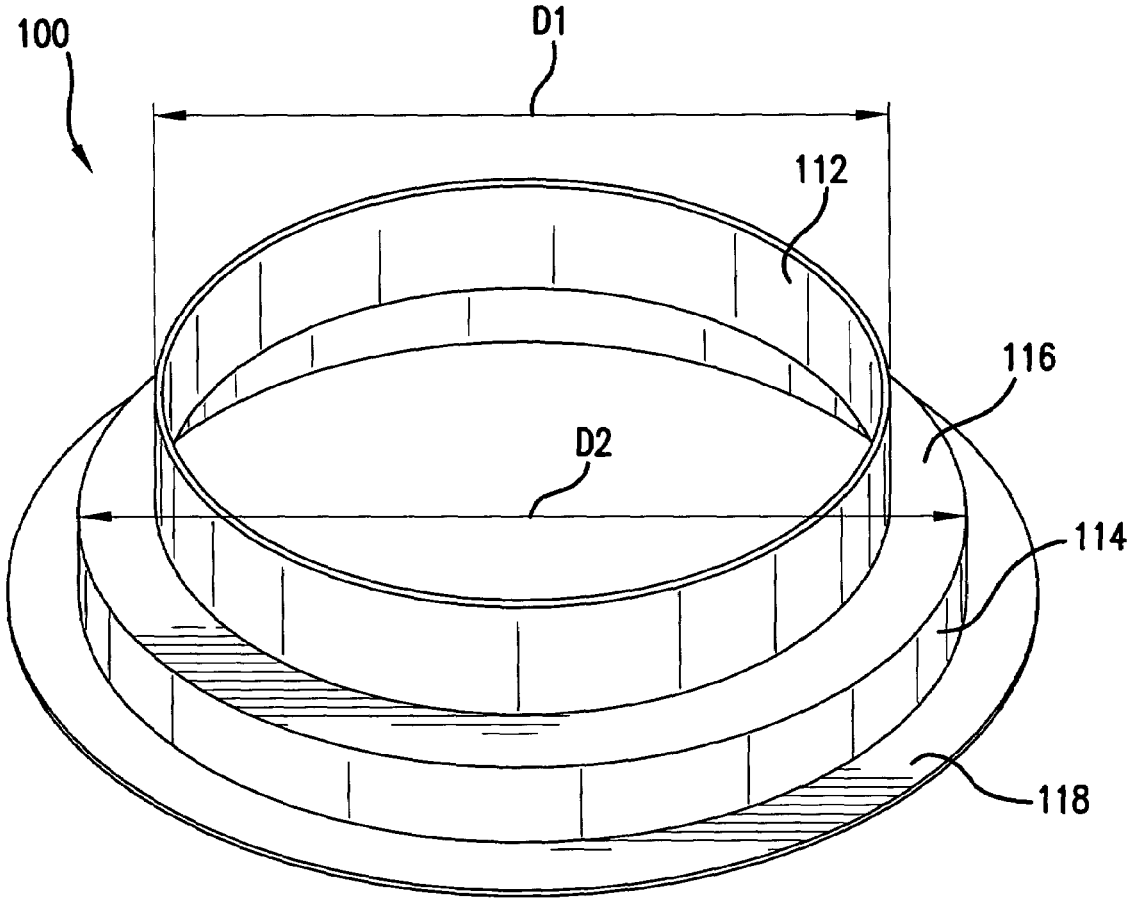
FIG. 3 is a perspective view of the form of FIG. 2.
Figure 4:
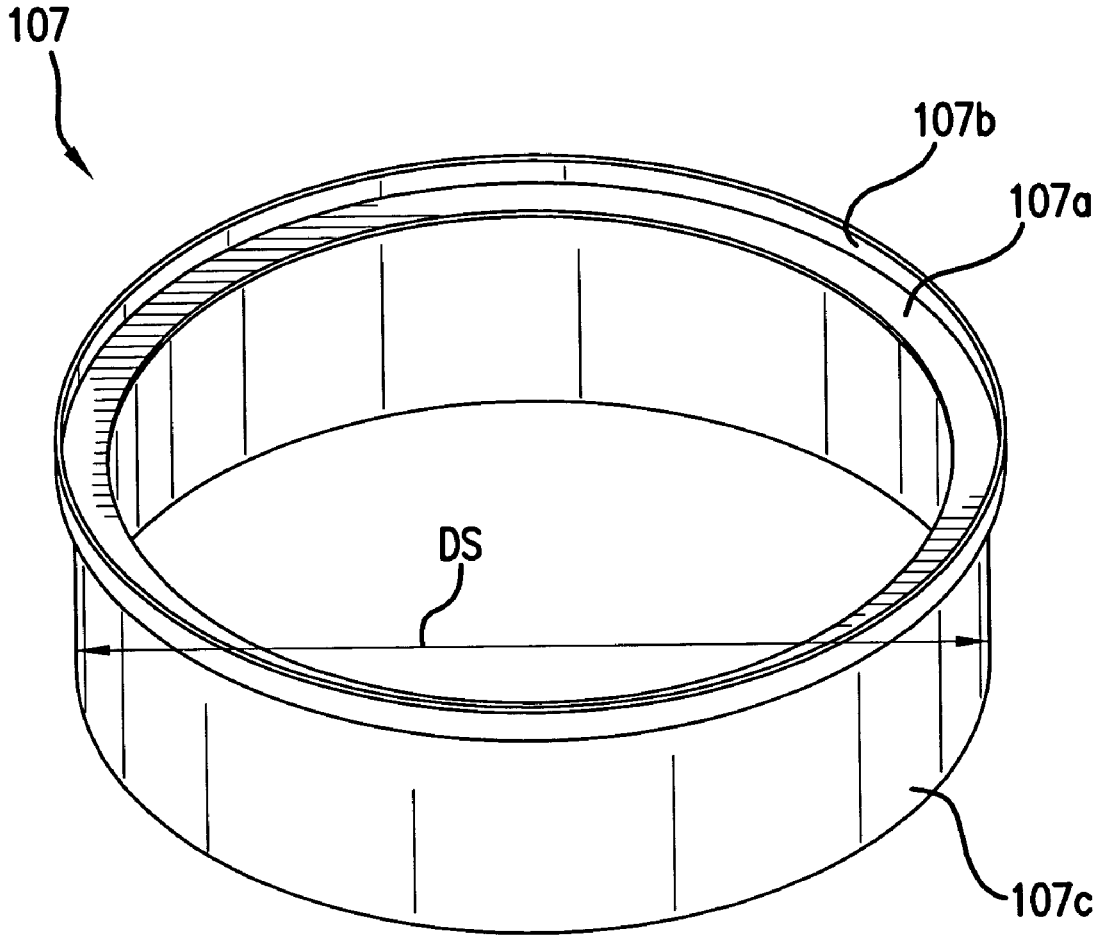
FIG. 4 is a perspective view of the street box of FIG. 2.

A street box 107 suitable for use with the form 100 of FIG. 3 is illustrated in FIG. 4. The street box 107, which is preferably formed from steel, includes a shoulder 107*a* with a rim 107*b* around the outer edge of the shoulder 107*a*. The shoulder 107*a* and rim 107*b* accept and support a street box cover (not shown in FIG. 4). The street box 107 has a sidewall 107*c* with an inside diameter DS that is larger than the outside diameter D1 of the upper portion 112 of the form 100. In other embodiments, the sidewall 107*c* is sized such that its outside diameter is smaller than an inside diameter of the form 100. However, it is preferable for the sidewall 107*c* to be fitted over the upper portion 112 of the form 100 so that the sidewall 107*c* is in contact with the cement of the pad (not shown in FIG. 4) in order to transfer the force exerted on the street box 107 by overpassing cars and trucks to the concrete pad.

Figure 5:
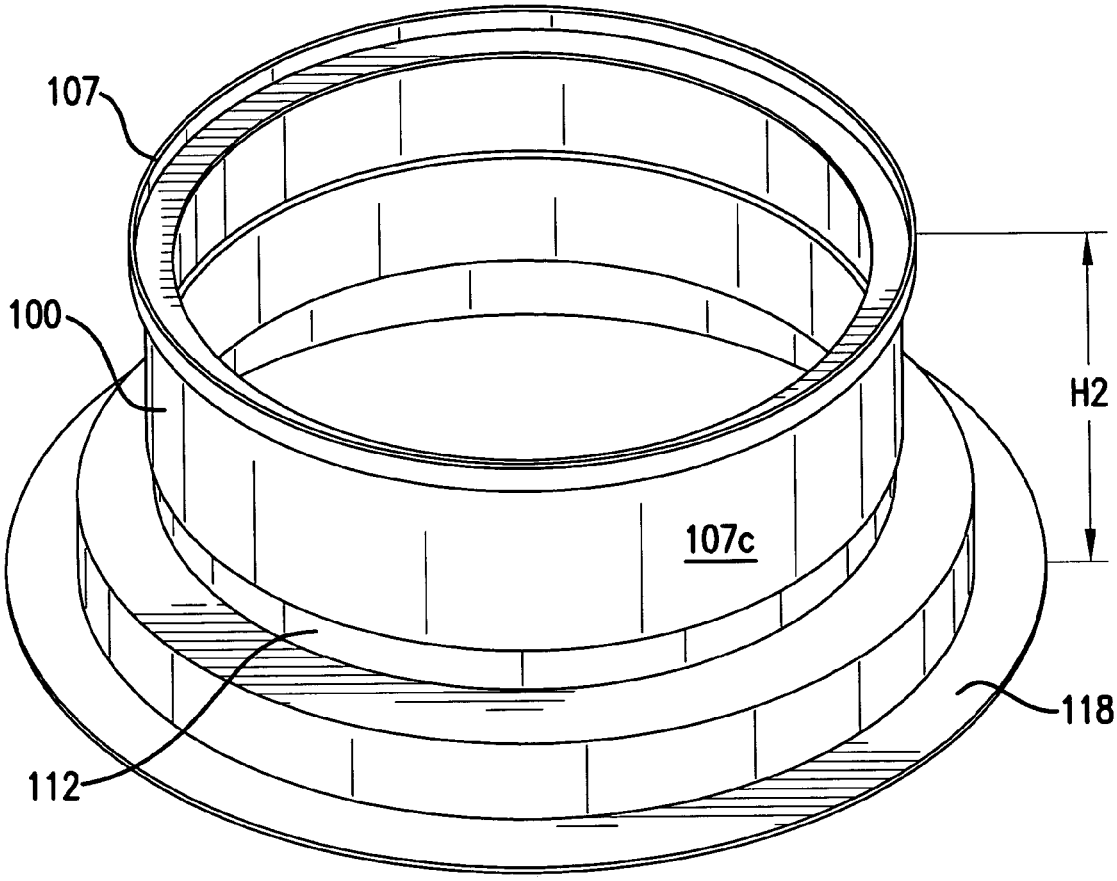
FIG. 5 is a perspective view of the street box of FIG. 4 mated with the form of FIG. 3.

FIG. 5 illustrates the street box 107 of FIG. 4 fitted over the form 100 of FIG. 3. The height H2 between the top of the street box 107 and the bottom flange 118 of the form 100 is adjustable due to the overlap between the sidewall 107*c* of the street box 107 and the upper portion 112 of the form 100. This simplifies installation as it facilitates "last minute" adjustments to the height of the street box 107 during backfilling and installation of the concrete pad without disturbing the position of the form 100. Thus, if needed, the height of the street box 107 can be raised a significant during installation without worry that the lower portion of the form 100 will be raised above the uppermost secondary containment point B of the riser 120 (as shown in FIG. 2).

Figure 6:
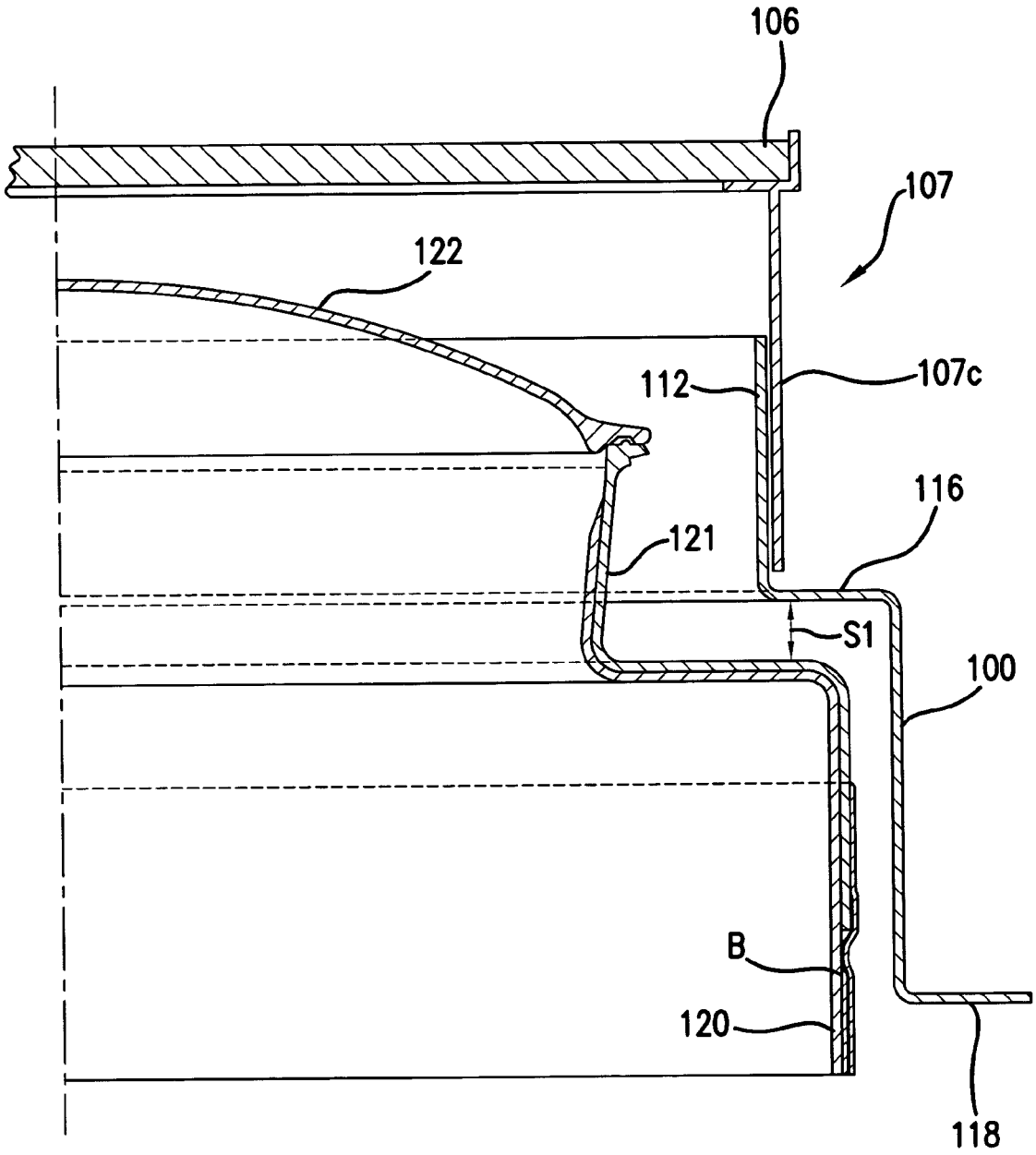
FIG. 6 is a side cross sectional view of a portion of the form, street box and riser of FIG. 2.

FIG. 6 illustrates portions of the riser 120, form 100 and street box 107 in greater detail. The double wall, secondary containment portion of the riser 120 terminates at a point B (that is, the portion of the riser below point B is formed of two walls separated by an interstitial space that is monitored for leaks). The bottom flange 118 on the form 100 extends below the point B. The form 100 is positioned such that a space S1 of at least 3 inches exists between the top 124 of the riser 120 and the underside of the transition surface 116 of the form 100. The sidewall 107*c* of the street box 107 and the upper portion 112 of the form 100 are in a closely spaced relationship. The spacing between the sidewall 107*c* and the upper portion 112 should be such that the height of the street box 107 can be adjusted during installation as discussed above. In some embodiments, the spacing between the sidewall 107*c* and upper portion 112 provide a friction fit that helps to keep the street box 107 at a desired height during installation. In other embodiments, the spacing between the sidewall 107*c* and the upper portion 112 is greater such that a gap exists around the entire circumference between the two and no friction fit is provided. Although the foregoing description has focused on embodiments in which the form has been used with a double-walled riser acting as a containment sump, it should be understood that the invention is not so limited and may be used with other risers including conventional, single walled risers, regardless of whether the riser is acting as a containment sump. Obviously, numerous other modifications and variations of the present invention are possible in light of the above teachings. It is therefore to be understood that within the scope of the appended claims, the invention may be practiced otherwise than as specifically described herein.

What is claimed is:

1. An underground storage system comprising:

an underground storage tank;

a riser connected to the underground storage tank, the riser having a top and a side wall;

a form having a lower portion and an upper portion, the form being positioned such that the lower portion surrounds a portion of the riser side wall; and a street box, the street box having a lower portion and an upper portion, the lower portion of the street box being sized and positioned such that it is in a closely spaced relationship with the upper portion of the form, the upper portion of the street box having a shoulder for accepting a street box cover; and a street box cover positioned on the shoulder, wherein the riser is configured to act as a containment sump and at least a portion of the side wall of the riser is a double walled portion comprising a first wall spaced apart from a second wall by an annular space, and a bottom of the lower portion of the form extends to a depth below a top of the double walled portion of the riser.

2. The system of claim 1, wherein a perimeter of the upper portion of the form is smaller than a perimeter of the lower portion of the form.

3. The system of claim 2, wherein the form further comprises a transition surface between and perpendicular to the lower and upper portions of the form such that the form has a stepped structure.

4. The system of claim 1, wherein a perimeter of a lower portion of the street box is larger than a perimeter of the upper portion of the form such that the lower portion of the street box surrounds the upper portion of the form.

5. The system of claim 1, wherein the riser has a circular cross sectional shape.

6. The system of claim 5, wherein the form has a circular cross sectional shape and the street box has a circular cross sectional shape.

7. The system of claim 1, wherein the bottom of the lower portion of the form includes an outward flange.

8. The system of claim 1, wherein the form comprises fiberglass.

9. A method for installing an underground storage system comprising the steps of:

placing an underground storage tank into a pit, the underground storage tank including a riser having a top and a side wall;

backfilling the pit such that the backfill reaches a point below a top of the riser;

placing a form over the riser such that a bottom of a lower portion of the form rests on the backfill;

fitting a lower portion of a street box to an upper portion of the form such that an upper portion of the street box is at a desired height, at least a portion of the upper portion of the form overlapping at least a portion of the lower portion of the street box;

adding additional backfill to the pit; and pouring a concrete pad over a portion of the backfill and around a side of the street box, wherein the riser is configured to act as a containment sump and at least a portion of the side wall of the riser is a double walled portion comprising a first wall spaced apart from a second wall by an annular space, and a bottom of the lower portion of the form extends to a depth below a top of the double walled portion of the riser.

10. The method of claim 9, wherein the bottom of the lower portion of the form includes an outward flange.

11. The method of claim 9, wherein the form is formed from fiberglass.

12. The method of claim 9, wherein a perimeter of the upper portion of the form is smaller than a perimeter of the lower portion of the form and the form further comprises a transition surface between and perpendicular to the lower and upper portions of the form such that the form has a stepped structure.

13. The method of claim 9, wherein the form has a circular cross sectional shape and the street box has a circular cross sectional shape.

14. An assembly suitable for use in an underground storage tank installation, the assembly comprising:

a street box, the street box having a top including a shoulder for supporting a street box cover and a sidewall; and a form, the form having an upper portion sized to be in a closely spaced relationship to the sidewall of the street box when the street box is fitted to the upper portion, the form further having a lower portion sized to be placed over a top of a riser connected to the underground storage tank, wherein the riser is configured to act as a containment sump and at least a portion of the side wall of the riser is a double walled portion comprising a first wall spaced apart from a second wall by an annular space. and a bottom of the lower portion of the form extends to a depth below a top of the double walled portion of the riser.

15. The assembly of claim 14, wherein the form is formed from fiberglass.

16. The assembly of claim 15, wherein a perimeter of the upper portion of the form is smaller than a perimeter of the lower portion of the form and the form further comprises a transition surface between and perpendicular to the lower and upper portions of the form such that the form has a stepped structure.

17. The assembly of claim 16, wherein the bottom of the form has an outward flange.

18. The assembly of claim 17, wherein the form has a circular cross-sectional shape.

* * * * *